United States Patent [19]

Somers

[11] Patent Number: 5,004,177

[45] Date of Patent: Apr. 2, 1991

[54] APPARATUS FOR BLOCKING A WINCH

[75] Inventor: James S. Somers, Dallas, Tex.

[73] Assignee: Concord Industries, Inc., Addison, Tex.

[21] Appl. No.: 442,222

[22] Filed: Nov. 28, 1989

[51] Int. Cl.[5] ..... B65H 23/06; B65H 75/00; B65H 75/26; B66D 5/32

[52] U.S. Cl. ..... 242/99; 242/106; 242/54 R; 254/376

[58] Field of Search ..... 242/99, 96, 106, 100, 242/129.8, 118.61, 47.04, 63, 86.7, 84.8, 85, 54 R; 254/224, 376; 188/82.4, 82.8

[56] References Cited

U.S. PATENT DOCUMENTS

| | | | |
|---|---|---|---|
| 67,310 | 7/1867 | Jadwin . | |
| 496,967 | 5/1893 | Archer | 254/376 |
| 756,989 | 4/1904 | Suhr . | |
| 964,035 | 7/1910 | Lombard . | |
| 975,114 | 11/1910 | Blank . | |
| 1,339,849 | 5/1920 | Johnson et al. . | |
| 1,364,031 | 12/1920 | Brenizer . | |
| 1,447,538 | 3/1923 | Fullington . | |
| 2,440,500 | 4/1948 | Ellis . | |
| 2,530,654 | 11/1950 | Ellis . | |
| 2,537,519 | 1/1951 | Eastman . | |
| 2,928,619 | 3/1960 | Burton et al. | 242/118.61 |
| 3,051,410 | 8/1962 | Miles | 242/100 |
| 3,652,027 | 3/1972 | Wong | 242/99 X |
| 3,952,695 | 4/1976 | Vollstedt . | |
| 4,106,719 | 8/1978 | Haverland . | |
| 4,204,651 | 5/1980 | Haverland . | |
| 4,236,618 | 12/1980 | West . | |
| 4,238,086 | 12/1980 | Brimmeier . | |
| 4,413,713 | 11/1983 | West . | |
| 4,431,144 | 2/1984 | Foster . | |
| 4,747,561 | 5/1988 | Sweeny et al. . | |
| 4,796,827 | 1/1989 | Munt, III et al. . | |

FOREIGN PATENT DOCUMENTS 454606 1/1928 Fed. Rep. of Germany .

OTHER PUBLICATIONS

"Flagpole of Distinction", author & date unknown.

*Primary Examiner*—Daniel P. Stodola
*Assistant Examiner*—John P. Darling
*Attorney, Agent, or Firm*—Harold E. Meier

[57] ABSTRACT

An apparatus for blocking a winch is disclosed. A winch reel is mounted between two opposed sideplates which are joined to form a frame. The winch reel includes a plurality of blocking pins extending substantially parallel to the central axis of the reel and away from one side of the reel. One sideplate of the frame incorporates a plurality of blocking apertures positioned to engage the blocking pins. A spring is interposed between the second sideplate to bias the reel in the direction of the sideplate having the blocking apertures. An inclined ramp is integral with and extends away from each of the blocking apertures in one rotational direction. The inclined ramps allow the winch to be readily rotated in one direction. Alternatively, the interaction of the blocking pins and the blocking apertures block rotation in the other direction unless a force is applied through a handle to compress the spring thereby shifting the reel and disengaging the blocking pins from the blocking apertures.

15 Claims, 4 Drawing Sheets

APPARATUS FOR BLOCKING A WINCH

TECHNICAL FIELD

The present invention relates to an apparatus for blocking a winch from rotation in a selected direction and is particularly applicable to winches of the type that are used within a flagpole to raise and lower flags.

BACKGROUND AND SUMMARY OF THE INVENTION

Small manually operated winches have innumerable applications and are used for a multitude of tasks including raising and lowering flags on flagpoles. Once a manually operated winch has been used to move an object, such as raising a flag, it is often necessary to block the winch in order to secure the object in its new position. It is also desirable to provide means for preventing a winch from free-wheeling if the winch crank is released after an object has been partially or fully moved.

In the past various mechanisms have been used to block winches and to prevent free-wheeling. For example, one commonly used method of blocking a winch is to mount a ratchet-type gear on the winch shaft that is engaged by a spring-loaded locking pawl. This mechanism allows the winch to turn freely in one direction while allowing rotation in the other direction only if the pawl is manually disengaged. The ratchet-pawl mechanism cannot, however, be used in the case of a winch that is mounted within a small enclosure, such as a hollow flagpole since the pawl would be difficult or impossible to reach within the enclosure. Another disadvantage of the ratchet-pawl mechanism is that it typically requires the use of both hands to disengage the pawl and rotate the winch crank when it is desired to move an object.

Various braking devices have also been employed as means for blocking winches and preventing free-wheeling. These mechanisms, however, tend to be complicated and prone to failure. The mechanisms employed in the past to block winches have also tended to be bulky and cumbersome and not suitable for use with a compact winch, particularly the type of winch that is mounted within a flagpole to raise and lower flags.

The apparatus of the present invention provides a simple and compact means for blocking a winch in position and preventing it from free-wheeling The apparatus of the present invention is adapted to one-handed use and is particularly suitable for winches mounted within enclosures. Moreover, the present invention has a minimal number of moving parts and is consequently reliable while simultaneously being inexpensive to manufacture.

Thus, the present apparatus and method for blocking a winch provides a technological improvement and economic advantage over past traditional practices and provides advantages heretofore unknown.

SUMMARY OF THE INVENTION

The present invention relates to apparatus for blocking a winch that is simple, reliable and relatively inexpensive to manufacture and use. Although the apparatus of the present invention can be utilized in many different applications, it is particularly useful for raising and lowering flags.

The apparatus of the present invention comprises a winch incorporating a blocking mechanism that prevents the winch from rotating in a selected direction when the winch handle is released. The blocking mechanism comprises a winch reel slideably mounted between opposed sideplates that are joined to form a winch frame. The winch reel comprises a plurality of flanges mounted on a drum that is in turn rotatably mounted between the sideplates of the winch housing. One of the sideplates is formed with blocking apertures. A removable handle is also provided to rotate the reel.

The winch reel is provided with blocking pins extending substantially parallel to the central axis of the reel from one of the flanges thereof, and located at positions corresponding to the blocking apertures. A spring is interposed between the reel and the sideplate opposite the sideplate wherein the blocking apertures are formed. Thus, when the reel is rotated to a location wherein the blocking pins are aligned with the blocking apertures, the spring shifts the reel causing the blocking pins to engage the blocking appertures.

Each of the blocking apertures is formed with an inclined ramp extending arcuately away from the blocking aperture in a direction corresponding to one direction of rotation of the reel. Thus, when the winch reel is rotated in a direction corresponding to the inclined ramps, the blocking pins engage the ramps thereby shifting the reel and compressing the spring. Alternatively, when it is desired to rotate the reel in the opposite direction, the spring must be compressed before the reel may be rotated.

For example, if the winch is employed to raise and lower a flag on a flagpole, the winch will be installed in such a manner that rotation in the direction of the inclined ramps will raise the flag and rotation in the opposite direction will lower the flag. Consequently, when raising the flag, it is only necessary to rotate the reel in the direction of the inclined ramps with the removable handle. When the flag is lowered, however, before the reel is rotated, it must be shifted to disengage the blocking pins. The reel is shifted and the blocking pins disengaged by applying a force to the removable handle along an axis corresponding to the central axis of the reel, thereby compressing the spring and shifting the reel to disengage the blocking pins. If the handle is released during the operation of the winch, the blocking pins will simply re-engage the blocking apertures thereby stopping the rotation of the winch reel.

BRIEF DESCRIPTION OF THE DRAWINGS

A more complete understanding of the invention and its advantages will be apparent from the detailed description taken in conjunction with the accompanying drawings in which.

DETAILED DESCRIPTION OF THE DRAWINGS

Figure 1:
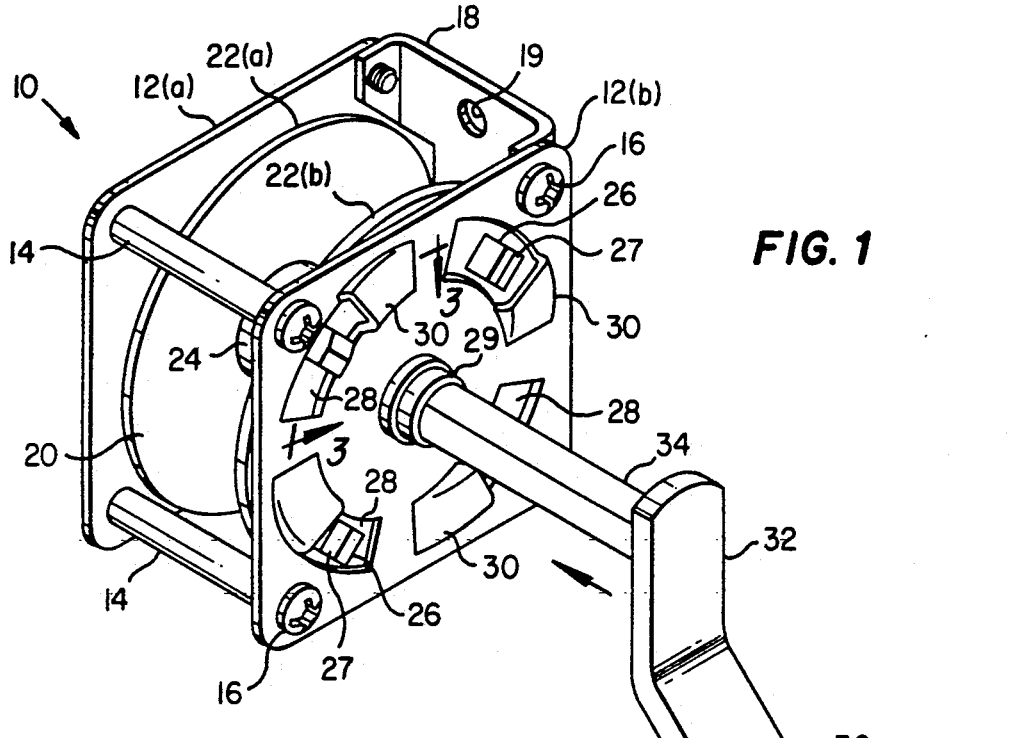
FIG. 1 is a perspective view of the apparatus illustrating a winch employing the blocking mechanism of the present invention.

FIG. 1 illustrates a winch embodying and employing the apparatus of the present invention. The winch 10 has a reel 20 mounted between opposed sideplates 12(*a*) and 12(*b*). Sideplates 12(*a*) and 12(*b*) are joined by screws 16 to a pair of spacer bars 14 and baseplate 18. To mount the winch 10 in an enclosure such as a flagpole, the baseplate 18 is provided with mounting apertures 19. Reel 20 includes flanges 22(*a*) and 22(*b*) and a drum 24. Attached to the flange 22(*b*) are blocking pins 26, each having a beveled end portion 27. The reel 20 is slideably mounted for limited movement along an axis perpendicular to sideplates 12(*a*) and 12(*b*).

Formed in the sideplate 12(*b*) are blocking apertures 28 located at positions corresponding to the radial location of blocking pins 26. The blocking apertures 28 are illustrated as arcuate elongated slots, however, these apertures may also be formed in a different geometry such as a round or square hole. An inclined disengaging ramp 30 extends from each blocking aperture 28 along a path corresponding to the path traveled by the blocking pins 26 during clockwise rotation of the reel. The inclined ramps 30 could, of course if desired, extend in a counterclockwise direction from the blocking apertures for counter clockwise rotation of the reel 20. To rotate the reel 20 a removable handle 32 is inserted into an extension 29 of the drum 24 through the sideplate 12(*b*). Removable handle 32 includes a shaft 34, a radially extending arm 36 and a rotating knob 38 for ease of operation.

Figure 2:
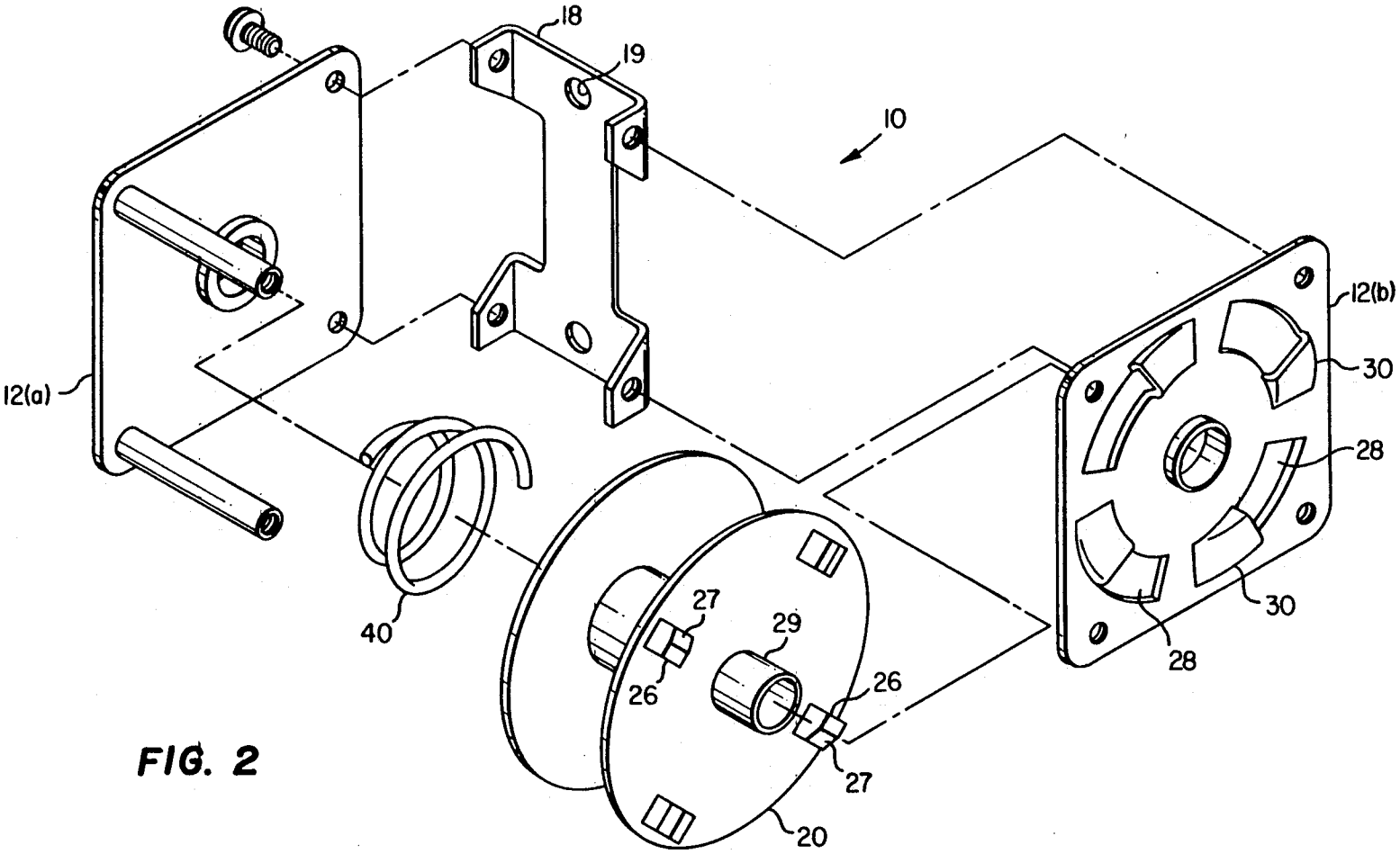
FIG. 2 is an exploded view of the apparatus of the present invention.

Turning now to FIG. 2, the construction of the present invention is illustrated in greater detail. A spring 40 is interposed between the reel 20 and sideplate 12(*a*) to bias the reel in the direction of the sideplate 12(*b*). In the operation of the winch 10, when the reel 20 is rotated in a clockwise direction, the beveled end portions 27 of the blocking pins 26 engage inclined ramps 30 thereby compressing the spring 40 and shifting the reel in the direction of the sideplate 12(*a*). Alternatively, rotation of the reel 20 in the counterclockwise direction is normally prevented by engagement of the blocking pins 26 with the blocking apertures 28.

Rotation of the reel 20 in a counterclockwise direction may, however, be accomplished by means of the handle 32 shifting reel 20 toward sideplate 12(*a*) thereby compressing spring 40 and disengaging blocking pins 26 from blocking apertures 28. Disengagement of blocking pins 26 from blocking apertures 28 is accomplished by applying a force to the removable handle 32 along an axis corresponding to the central axis of reel 20. The applied force causes reel 20 to shift toward sideplate 12(*a*) thereby compressing spring 40 and disengaging blocking pins 26 from blocking apertures 28.

Thus, if winch 10 were mounted in an enclosure comprising a flagpole (not shown) in such a manner that clockwise rotation of the reel 20 would raise the flag and counterclockwise rotation of the reel 20 would lower the flag, the flag could readily be raised by rotating removable handle 32 in a clockwise direction. Once the flag was raised, removable handle 32 would be removed and the winch 10 would be blocked in position by the engagement of blocking pins 26 with blocking apertures 28, thereby maintaining the flag in an elevated position. Alternatively, when it is desired to lower the flag, removable handle 32 is inserted and a force is applied along an axis corresponding to the central axis of the reel 20, thereby compressing spring 40 and disengaging blocking pins 26 from blocking apertures 28 whereupon the reel 20 is readily rotated in a counterclockwise direction, thereby lowering the flag.

Figure 3:
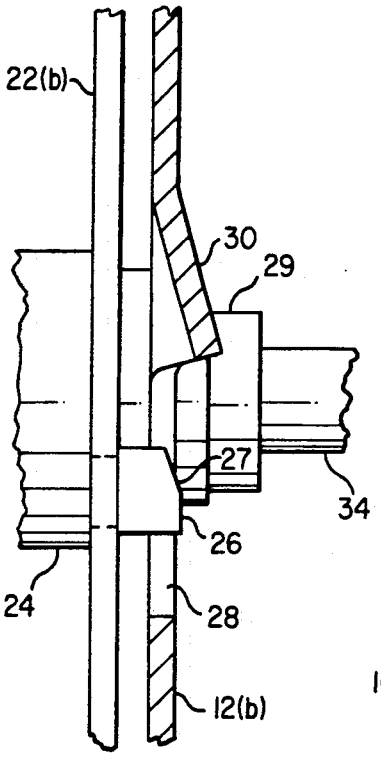
FIG. 3 is a partial cross-sectional view of FIG. 1 along lines 3—3.

FIG. 3 further illustrates the operation of the blocking pins 26 and the inclined ramp 30. When a blocking pin 26 is engaged with the blocking aperture 28 through the action of the spring 40, the beveled end portion 27 of the blocking pin 26 is positioned to engage the inclined ramp 30 upon rotation of the reel 20 in a clockwise direction. As the blocking pin 26 moves along inclined ramp 30, the reel 20 is shifted away from sideplate 12(*b*) thereby compressing spring 40.

Figure 4:
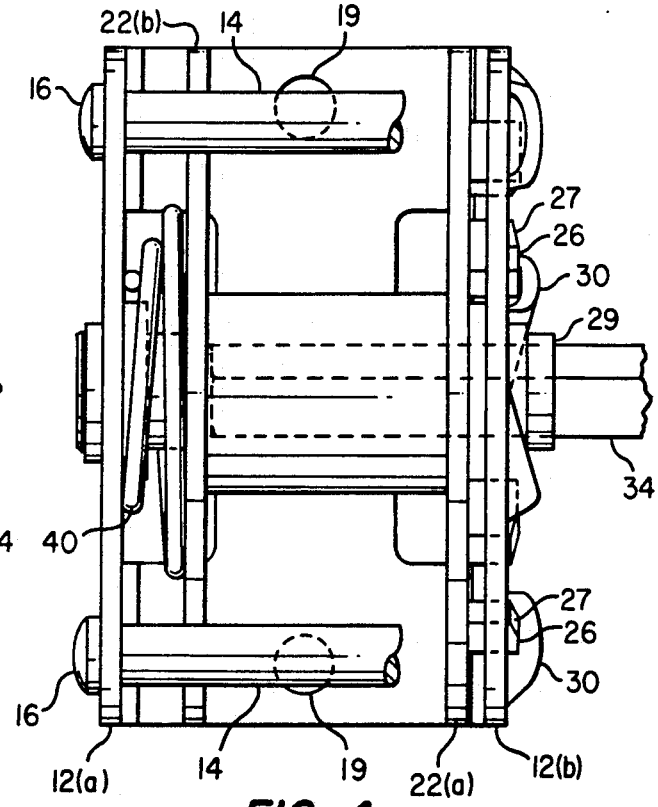
FIG. 4 is a top view of the apparatus illustrating the winch in a blocked position.

FIG. 4 shows the apparatus of the present invention in its blocked position. The reel 20, through the action of the spring 40 is shifted toward sideplate 12(*b*) thereby engaging blocking pins 26 with blocking apertures 28.

Figure 5:
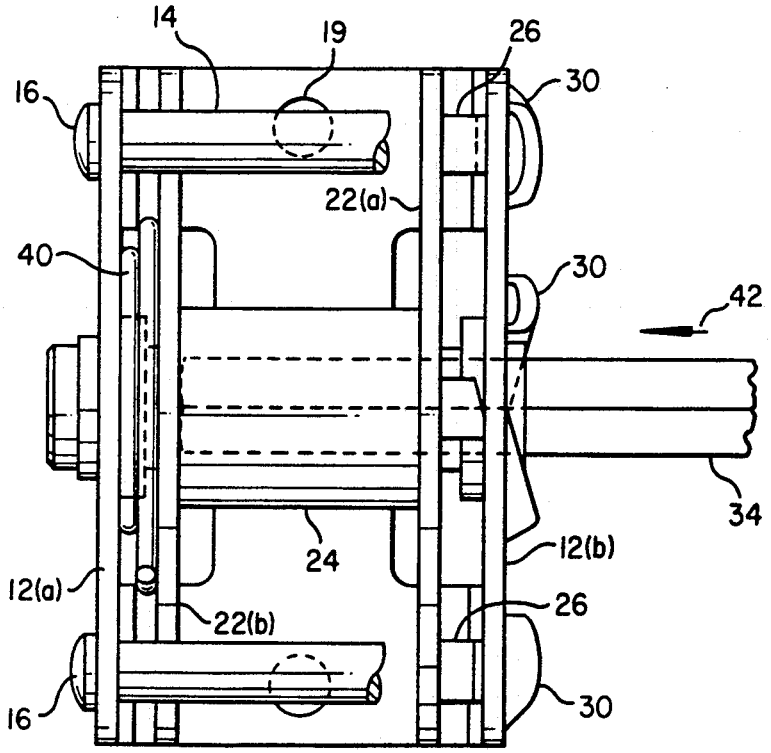
FIG. 5 is a top view of the apparatus showing the winch in an unblocked position.

FIG. 5 shows the apparatus of the present invention in its unblocked position. A force, represented by arrow 42, acts on the reel 20 to compress the spring 40. The reel 20 is shifted toward sideplate 12(*a*) and blocking pins 26 are disengaged from blocking apertures 28. In this position, the reel 20 may be readily rotated in a counterclockwise direction.

Figure 6:
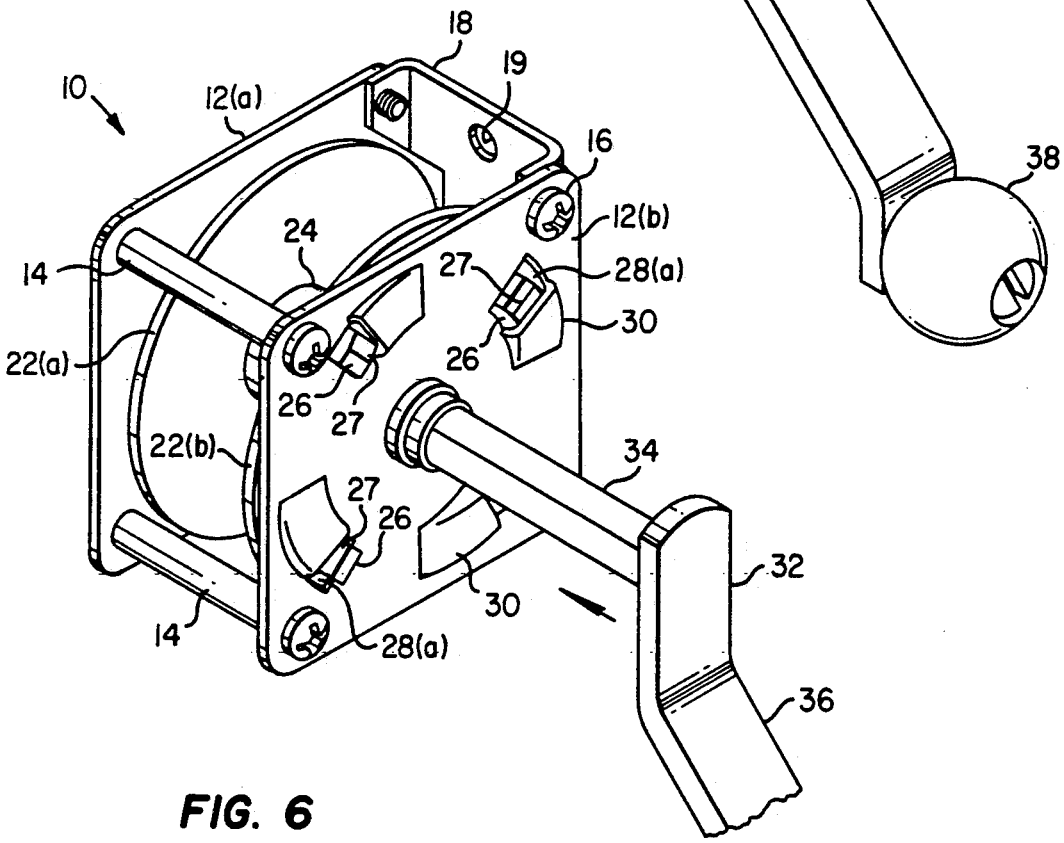
FIG. 6 is a perspective view of an alternate embodiment of the invention wherein the blocking pin receiving apertures are rectangular holes rather than elongated slots.

FIG. 6 shows an alternate embodiment of the present invention wherein the blocking apertures comprise square holes 28(*a*) as opposed to arcuate elongated slots.

Figure 7:
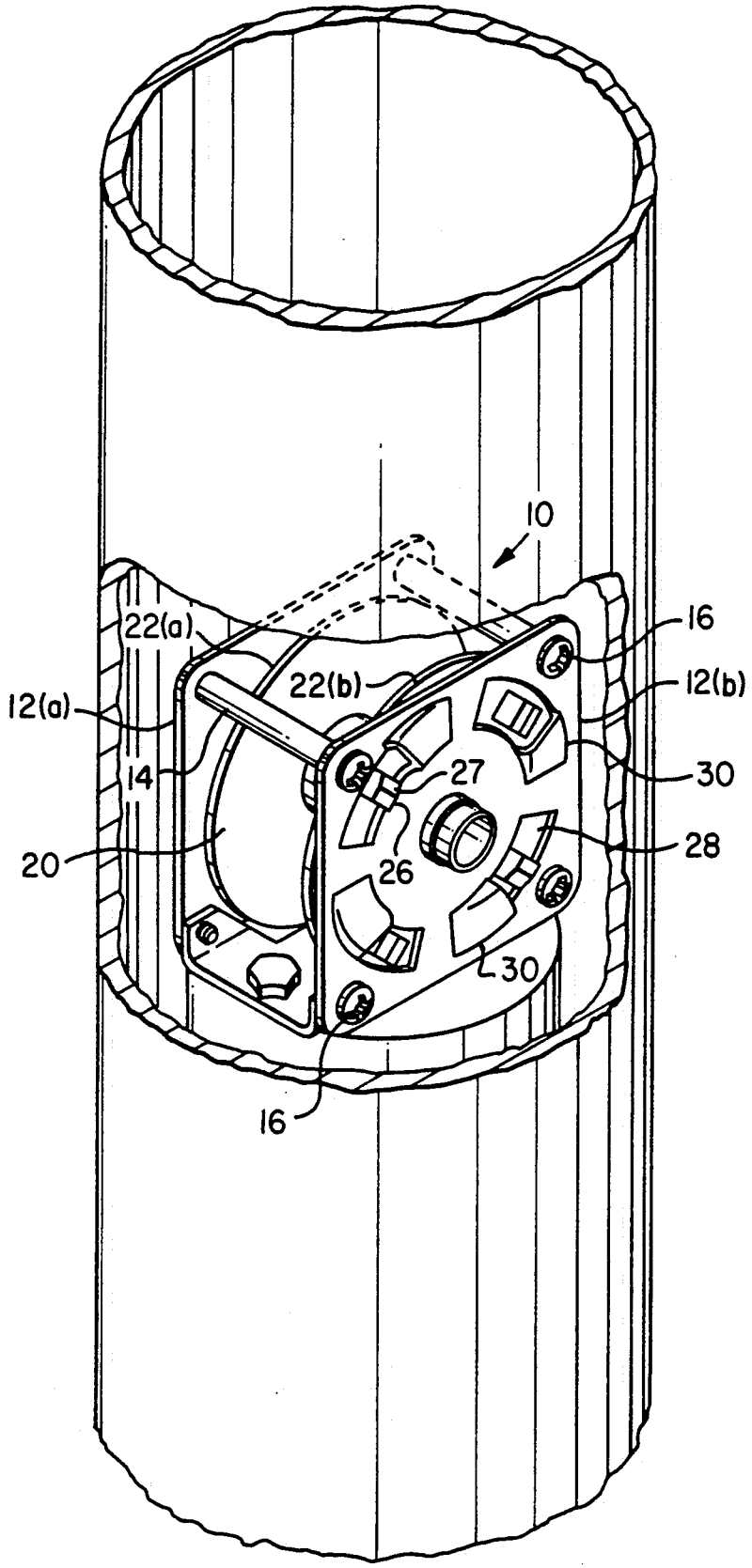
FIG. 7 illustrates the apparatus of the present invention mounted in a cylindrical enclosure such as a flagpole.

FIG. 7 illustrates apparatus of the present mounted within a cylindrical winch-receiving enclosure such as a flagpole. Although the illustrated enclosure is cylindrical, numerous other enclosures of different geometries could be utilized.

Although preferred embodiments of the invention have been illustrated in the accompanying drawings and described in the foregoing detailed description, it will be understood that the invention is capable of numerous rearrangements, modifications and substitution of parts and elements without departing from the spirit and scope of the invention.

I claim:

1. A blocking winch comprising:

a reel having a central axis and including at least one blocking pin extending substantially parallel to the central axis and away from one end of said reel;

a frame for rotatably supporting said reel, said frame comprising opposed sideplates joined together to form said frame, one of said sideplates including at least one blocking aperture and a blocking disengaging ramp formed adjacent to and extending arcuately away from at least one blocking aperture along an arch corresponding to one direction of rotation of said reel;

a spring adapted for engagement with said frame and said reel for causing at least one blocking pin to engage at least one blocking aperture; and, means for engaging said reel whereupon said spring is compressed to enable rotation of said reel.

2. The winch as set forth in claim 1 wherein said reel comprises a drum and a plurality of flanges mounted thereon.

3. The winch as set forth in claim 1 wherein at least one blocking aperture comprises an arcuate elongated aperture.

4. The winch as set forth in claim 1 wherein said spring biases said reel in the direction of a sideplate of said frame.

5. The winch as set forth in claim 1 further comprising a base plate for mounting said winch.

6. The winch as set forth in claim 1 wherein at least one blocking pin further comprises a beveled end portion for engaging said blocking disengaging ramp.

7. The winch as set forth in claim 1 wherein said reel is adapted for movement along an axis substantially perpendicular to said sideplates.

8. The winch as set forth in claim 1 wherein said spring is interposed between one of said sideplates and said reel.

9. The winch as set forth in claim 1 further comprising a cylindrical enclosure.

10. The winch as set forth in claim 1 wherein said cylindrical enclosure comprises a flagpole.

11. The winch as set forth in claim 1 further comprising a cylindrical enclosure.

12. The winch as set forth in claim 11 wherein said cylindrical enclosure comprises a flagpole.

13. A blocking winch comprising:

a reel comprising a drum, a pair of flanges mounted to said drum and a plurality of blocking pins, said blocking pins mounted to extend substantially perpendicular to and away from one of said flanges;

a frame for rotatably supporting said reel, said frame comprising opposing sideplates joined together to form said frame, said frame being adapted to allow said reel to move along an axis perpendicular to the sideplates of said frame, one of said sideplates further comprising a plurality of arcuate blocking apertures;

a plurality of arcuate inclined disengaging ramps, each of said ramps being formed to extend away from said blocking apertures along an arc corresponding to one direction of rotation of said reel;

a coil spring interposed between the second of said sideplates and the second flange of said reel for causing said blocking pins to engage said blocking apertures; and means for engaging said reel whereupon said spring is compressed to enable rotations of said reel.

14. The winch as set forth in claim 13 further comprising a cylindrical enclosure.

15. The winch as set forth in claim 14 wherein said cylindrical enclosure comprises a flagpole.

* * * * *